US008539625B2

(12) United States Patent
Poulos et al.

(10) Patent No.: US 8,539,625 B2
(45) Date of Patent: Sep. 24, 2013

(54) BED GAP SHIELD

(75) Inventors: Craig Poulos, Wilmette, IL (US); Joseph Immordino, Hoffman Estates, IL (US); Patrick Harris, Downers Grove, IL (US); Timothy J. Fischer, Chicago, IL (US); John Peklo, Glen Ellyn, IL (US)

(73) Assignee: Kreg Medical Inc., Chicago, IL (US)

( * ) Notice: Subject to any disclaimer, the term of this patent is extended or adjusted under 35 U.S.C. 154(b) by 86 days.

(21) Appl. No.: 12/888,798

(22) Filed: Sep. 23, 2010

(65) Prior Publication Data

US 2011/0247141 A1 Oct. 13, 2011

Related U.S. Application Data

(60) Provisional application No. 61/277,303, filed on Sep. 23, 2009.

(51) Int. Cl.
*A47C 31/00* (2006.01)

(52) U.S. Cl.
USPC ..... 5/658; 5/663; 5/618; 5/617; 5/600

(58) Field of Classification Search
USPC ..... 5/618, 658, 613, 185, 600, 663
See application file for complete search history.

(56) References Cited

U.S. PATENT DOCUMENTS 4,370,765 A 2/1983 Webber
4,613,182 A 9/1986 Stone
4,669,136 A * 6/1987 Waters et al. ..... 5/185
4,672,698 A 6/1987 Sands
4,918,829 A 4/1990 Harris
5,077,843 A 1/1992 Foster et al.
5,083,332 A 1/1992 Foster et al.
5,084,925 A 2/1992 Cook
5,179,744 A 1/1993 Foster et al.
5,214,809 A 6/1993 Stuart
5,377,370 A 1/1995 Foster et al.
5,481,770 A * 1/1996 Ahlsten ..... 5/185
5,481,772 A 1/1996 Glynn et al.
5,485,699 A 1/1996 Gabhart
5,732,423 A 3/1998 Weismiller et al.
5,745,936 A 5/1998 Van McCutchen et al.
5,749,112 A 5/1998 Metzler
5,784,732 A 7/1998 Vail
5,878,452 A 3/1999 Brooke et al.
6,038,721 A 3/2000 Gordon
6,112,345 A 9/2000 Foster et al.
6,256,822 B1 7/2001 Weston et al.
6,347,422 B2 2/2002 Heavrin
6,360,385 B1 3/2002 Lewandowski (Continued)

*Primary Examiner* — Peter M Cuomo
*Assistant Examiner* — Brittany Wilson
(74) *Attorney, Agent, or Firm* — McDermott Will & Emery LLP

(57) ABSTRACT

A gap shield assembly for shielding an open area between a first section of a bed and an adjacent second section of the bed. The gap shield has a first shield member and a second shield member. The second shield member is rotatably connected to the second section of the bed. The first shield member is rotatably and translationally connected to the second shield member. The gap shield assembly also has a width extender assembly connecting the first shield member to the first section of the bed to allow the first shield member to move inwardly and outwardly with respect to a centerline of the bed while still shielding the open area between the first and second sections of the bed.

20 Claims, 9 Drawing Sheets

(56) References Cited

U.S. PATENT DOCUMENTS

| | | | | |
|---|---|---|---|---|
| 6,363,552 | B1 | 4/2002 | Hornbach et al. | |
| 6,374,437 | B1 | 4/2002 | Voelker | |
| 6,401,277 | B1 | 6/2002 | Savage et al. | |
| 6,427,264 | B1 | 8/2002 | Metz et al. | |
| 6,446,283 | B1 | 9/2002 | Heimbrock et al. | |
| 6,460,930 | B2 | 10/2002 | Thornton | |
| 6,622,323 | B2 | 9/2003 | Zerhusen et al. | |
| 6,622,364 | B2 | 9/2003 | Hamilton et al. | |
| 6,640,360 | B2 | 11/2003 | Hornbach et al. | |
| 6,640,361 | B2 | 11/2003 | Heimbrock et al. | |
| 6,678,908 | B2 | 1/2004 | Borders et al. | |
| 6,694,557 | B1 | 2/2004 | Bobey et al. | |
| 6,704,954 | B2 | 3/2004 | Metz et al. | |
| 6,721,975 | B1 | 4/2004 | Lemire | |
| 6,728,985 | B2 | 5/2004 | Brooke et al. | |
| 6,779,209 | B2 | 8/2004 | Ganance | |
| 6,799,340 | B2 | 10/2004 | Schatz | |
| 6,820,293 | B2 | 11/2004 | Alverson | |
| 6,829,793 | B2 | 12/2004 | Brooke et al. | |
| 6,829,796 | B2 | 12/2004 | Salvatini et al. | |
| 6,874,179 | B2 | 4/2005 | Hensley et al. | |
| 6,928,673 | B2 | 8/2005 | Risk, Jr. | |
| 6,951,036 | B2 | 10/2005 | Lemire | |
| 6,952,846 | B2 | 10/2005 | Flannery et al. | |
| 7,007,323 | B2 | 3/2006 | Zerhusen et al. | |
| 7,028,352 | B2 | 4/2006 | Kramer et al. | |
| 7,028,358 | B2 | 4/2006 | Liu | |
| 7,107,636 | B2 | 9/2006 | Metz et al. | |
| 7,107,637 | B2 | 9/2006 | Kuek et al. | |
| 7,111,340 | B2 * | 9/2006 | Mitchell et al. | 5/185 |
| 7,412,734 | B2 | 8/2008 | Stryker et al. | |
| 7,444,696 | B2 * | 11/2008 | Lin et al. | 5/613 |
| 2006/0021142 | A1 * | 2/2006 | Hornbach et al. | 5/613 |
| 2010/0005592 | A1 * | 1/2010 | Poulos et al. | 5/613 |

* cited by examiner

FIG. 1
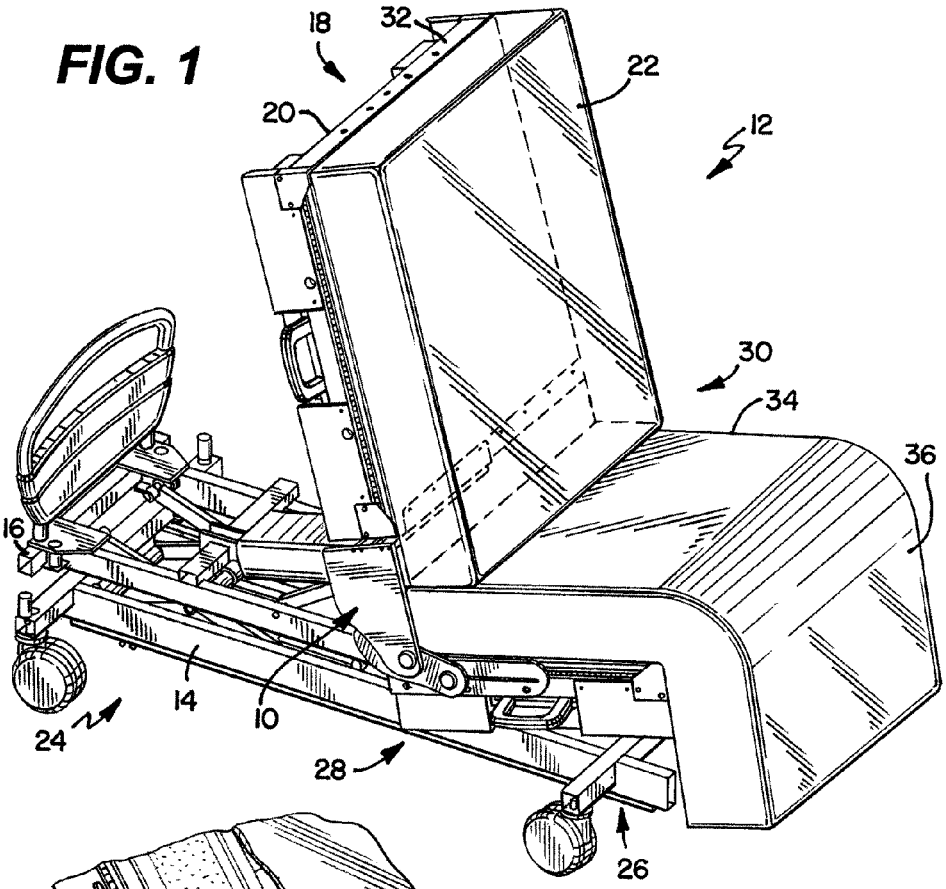
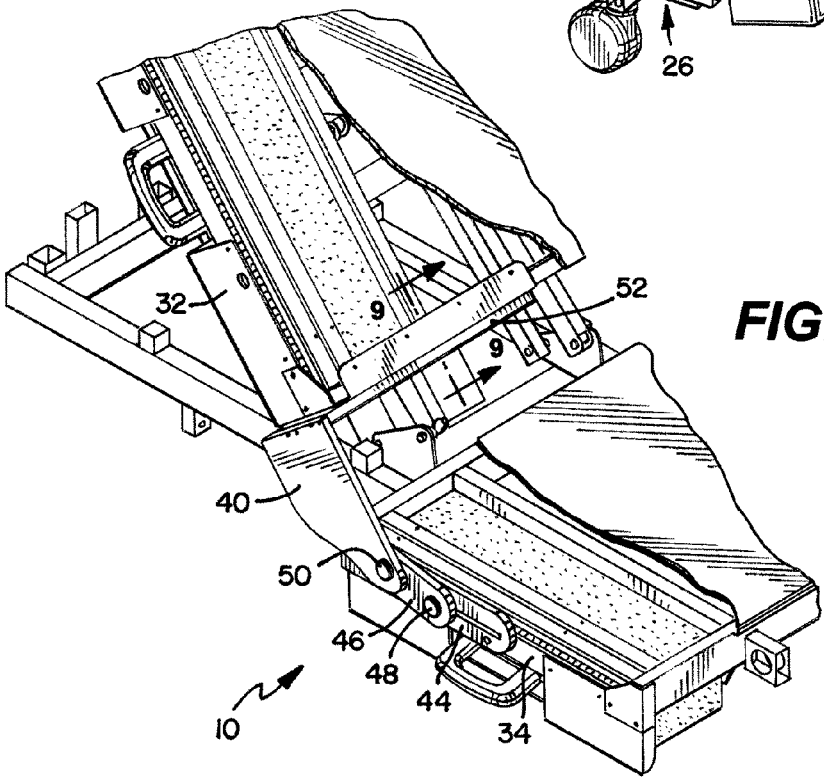
FIG. 2

BED GAP SHIELD

CROSS-REFERENCE TO RELATED APPLICATIONS

This application is a continuation of U.S. Provisional Patent Application No. 61/277,303, filed on Sep. 23, 2009, which is expressly incorporated herein by reference and made a part hereof.

FEDERALLY SPONSORED RESEARCH OR DEVELOPMENT

Not Applicable.

TECHNICAL FIELD

The present invention relates generally to a gap shield, and more specifically to a gap shield for an articulating bed.

BACKGROUND OF THE INVENTION

Hospital beds are well known in the art. One type of hospital bed is an articulating bed. Another type of hospital bed is an expandable width bed. Expandable width beds generally include an expandable frame and mattress fillers therewith. While such articulating and expandable width beds according to the prior art provide a number of advantageous features, they nevertheless often have certain limitations, including possibly having undesirable gaps between various sections of the bed. Such undesirable gaps may be present in standard hospital beds as well. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides a gap shield assembly for shielding an open area between a first section of a bed, such as the head section, and an adjacent second section of the bed, such as a seat section. Preferably, the gap shield assembly prevents someone from inserting their hand or other body part from the side of the bed into the area between the head and seat sections of an articulating bed.

According to one embodiment, the gap assembly comprises a first shield member positioned adjacent a first side of the bed and a second shield member positioned adjacent the first side of the bed. The first shield member is mechanically connected to the second shield member when the bed is in the horizontal position and when the first section of the bed is raised. According to another embodiment, the first shield member and the second shield member are not separable during articulation of the bed.

According to another embodiment, one of the first shield member and the second shield member is rotationally connected to the deck to which it is connected, and the other of the first shield member and the second shield member cannot rotate with respect to the deck to which it is connected.

According to another embodiment, a coupler rotationally connects the second shield member to the seat section, and a follower rotationally connects the first shield member to the second shield member. The coupler also laterally fixes the position of the second shield member with respect to the bed.

According to another embodiment, one of the first shield member and the second shield member has a cam track for retaining a cam connected to the other of the first shield member and second shield member for rotationally and translationally securing the first shield member to the second shield member. According to another embodiment, the first shield member has the cam track for retaining a cam connected to the second shield member for rotationally and translationally securing the second shield member to the first shield member.

According to another embodiment, a supplemental shield is also provided between the first shield member and the second shield member. The supplemental shield is generally rotationally connected to both the first shield member and the second shield member.

According to another embodiment, a width extender assembly is also provided. The width extender assembly connects one of the first shield member to the first section of the bed and the second shield member to the adjacent second section of the bed to allow the shield member connected to the width extender assembly to move inwardly and outwardly with respect to a centerline of the bed while still shielding the open area between the first and second sections of the bed. In such an embodiment, the other of the first shield member and the second shield member is connected to the bed.

According to another embodiment, the width extender assembly is connected to the first shield member and the first section of the bed. The width extender assembly further comprises an extender receiver connected to the first section of the bed and an extender follower member that is connected to the first shield member. The extender follower member is movably connected to the extender receiver.

According to another embodiment, the width extender assembly comprises an extender receiver connected to the first section of the bed and an extender follower member connected to the first shield member. The extender follower member is movably connected to the extender receiver.

According to another embodiment, the gap shield assembly comprises a first shield member connected to a first section of the bed and positioned adjacent a first side of the bed, and a second shield member connected to a second section of the bed. The first shield member is movably connected to the second shield member during articulation of the bed. During articulation, one of the first shield member and the second shield member translates about a longitudinal axis of the bed and rotates with respect to the other of the first shield member and the second shield member during such articulation. The other of the first shield member and the second shield member remains laterally fixed about a longitudinal axis of the bed during articulation of the bed.

According to another embodiment, the first and second shield members are provided below a deck surface of the bed.

According to another embodiment, the shield member that remains laterally fixed about a longitudinal axis of the bed during articulation of the bed also rotates with respect to the bed during articulation of the bed.

According to another embodiment, the gap shield is provided for shielding an open area between a head section of a bed and an adjacent seat section of a bed. The gap shield comprises a first shield member connected to the head section of the bed and positioned adjacent a side of the bed, and a second shield member connected to the seat section of the bed and positioned adjacent a side of the bed. One of the first shield member and the second shield member is rotationally connected to the section of the bed to which it is connected to rotate with respect to the bed section to which it is connected, and the other of the first shield member and the second shield member is rotationally fixed to the section of the bed to which it is connected. Additionally, one of the first shield member and the second shield member has a cam track for retaining a cam connected to the other of the first shield member and second shield member for rotationally and translationally securing the first shield member to the second shield member.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 1 is a perspective view of one embodiment of a hospital bed with the head section in an upward position, and having a gap shield assembly between the head section and the seat section;

FIG. 2 is a partial cutaway perspective view of one embodiment of a hospital bed having mattress extenders in the closed position, with the head section in a partial upward position, and having a gap shield assembly between the head section and the seat section;

DETAILED DESCRIPTION

Figure 3:
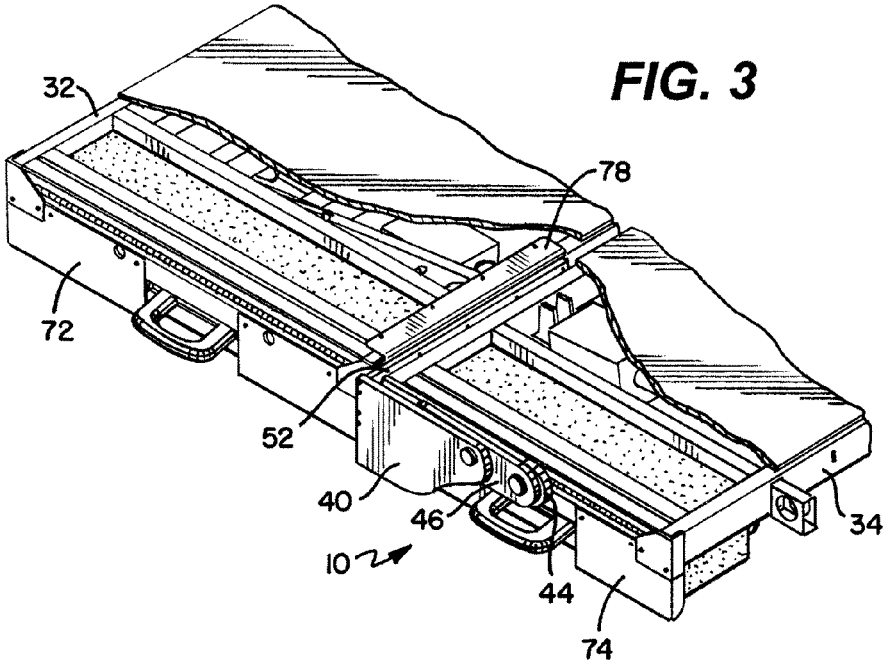
FIG. 3 is a partial cutaway perspective view of one embodiment of a hospital bed having mattress extenders in the closed position, with the head section in a lowered position, and having a gap shield assembly between the head section and the seat section.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the Figures, there are shown various embodiments of a gap shield assembly 10 for a hospital bed 12. The term "bed" herein is used to denote any embodiment of a support for a patient. As such, in different embodiments the "bed" may be provided as a standard hospital bed, an articulating bed, a chair bed, an expandable width bed, a stretcher, a gurney or some other patient support or combination thereof. For example, in the chair bed configuration the bed is manipulated to achieve both a conventional bed position having a substantially horizontal patient support or sleeping surface upon which a user lies in a supine position, and a sitting position wherein the user's feet are on or adjacent the floor and the back of the user is supported by a raised back support. Similarly, as another example, in the expanding width bed configuration the bed is manipulated to convert to a wider patient support surface at various portions of the bed. The width of the expanding width bed 12 may be narrowed, however, to that of a conventional hospital bed to provide for ease of mobility of the bed 12. Additionally, in another embodiment the bed 12 is a bariatric bed, meaning it is provided to support morbidly obese patients.

The bed 12 generally comprises a base assembly 14, an intermediate frame assembly 16, and a patient support assembly 18. In one embodiment at least a portion of the support deck assembly 20 extends from and is connected to the intermediate frame assembly 16. The patient support assembly 18 preferably comprises a support deck assembly 20 and a mattress 22, however, either component individually or both collectively may be identified as the patient support. The patient support assembly 18 may also include a patient support extension assembly, also referred to as a deck or mattress extension assembly. The mattress 22 may be a foam mattress, inflatable mattress, fluidized mattress, percussion mattress, rotation mattress or any other type of mattress known in the art. As explained above, in one embodiment the bed 12 will be capable of transitioning to a chair orientation and to an expanded width orientation.

The bed 12 preferably has a head end 24, a foot end 26 opposing the head end 24, a first side 28, and a second side 30 opposing the first side 28. The term "head end" is used to denote the end of any referred to object that is positioned to lie nearest the head end 24 of the bed 12, and the term "foot end" is used to denote the end of any referred to object that is positioned to lie nearest the foot end 26 of the bed 12.

Additionally, in a preferred embodiment the bed 12 has a plurality of different sections, which may be articuable sections. For example, in the embodiment illustrated, the bed 12 has a head section 32, a seat section 34 and a foot section 36. The head section 32 may also be referred to as a first section, the seat section 34 may also be referred to as a second section, and the foot section 36 may also be referred to as a third section. The seat section 34 is positioned between the head section 32 and the foot section 36. In various embodiments of the bed, the head section 32 is generally moveable from a generally horizontal position to a more vertical back-support position. Similarly, in various embodiments of the bed 12, such as a chair bed as shown in FIG. 1, the foot section 36 is moveable from a generally horizontal position to a substantially vertical position.

In a preferred embodiment, the bed 12 can assume a plurality of positions/orientations via manipulation of the intermediate frame assembly 16 and the various sections of the bed 12. Further, as detailed herein, in different embodiments the mattress 22 can also attain a variety of positions/orientations.

As examples of the different orientations that can be attained, the bed 12 can assume a standard bed position such that the support deck assembly 20 is in the horizontal position, the bed 12 can assume a chair orientation such as shown in FIG. 1, and the bed 12 can assume a variety of positions therebetween. Additionally, the intermediate frame assembly 16 can be independently raised and lowered at the head end 24 and foot end 26 of the bed 12. As such, when the foot end 26 of the intermediate frame assembly 16 is raised and the head end 24 is maintained in a lowered position the bed 12 can assume the Trendelenburg position, and conversely when the head end 24 of the intermediate frame assembly 16 is raised and the foot end 26 is maintained in a lowered position the bed 12 can assume the reverse Trendelenburg position. Further, the entire intermediate frame assembly 16 can be raised simultaneously to assume a raised bed orientation, and the entire intermediate frame assembly 16 can be lowered simultaneously to assume a lowered bed orientation or a lowered chair bed orientation as shown in FIG. 1.

As explained above, referring to FIGS. 1, 7, 8 and 10, the bed 12 may also have one of a variety of gap shield assemblies 10. The gap shield assembly 10 can be utilized on any type of bed 12, including standard hospital beds, articulating beds, chair beds, expandable width beds, etc. The gap shield assembly 10 operates to provide a shield between adjoining bed sections to assist in precluding access to the area, generally from the side, between adjoining bed sections. Accordingly, the gap shield assembly 10 is generally utilized as a safety mechanism to preclude unwanted entrance of body parts, machinery, etc., between various sections of the bed 12. Preferably, as shown in FIG. 1, the shield assembly 10 is located below the surface of the mattress 22, and is entirely distinct from a siderail for the bed 12.

In one embodiment, the gap shield assembly 10 generally comprises a shield member 40 (also referred to herein as a first shield member 40), a follower member 41 and a receiver 44 (also referred to herein as a second shield member 44). The receiver 44 is also referred to as the second shield member 44. In additional embodiments, the gap shield assembly 10 may also comprise a supplemental shield 46, a first coupler 48, and/or a second coupler 50. Further, in additional embodiments as described herein, especially with expandable width beds, the gap shield assembly 10 also comprises an extender 52, incorporating a second follower member 54 and a second receiver 56. Generally, the extender is not needed unless the bed has expandable width aspects thereto. It is also understood that certain components may be combined, for example, the coupler and the follower member may be combined in a single component.

Generally, the shield member 40 is connected to one of the bed sections and the receiver 44 is connected to another of the bed sections. For example, as shown in FIG. 1, the shield member 40 is connected to the head section 32 and the receiver 44 is connected to the seat section 34, however, it is understood that the connections may be reversed or that they may be connected to different sections of the bed, including sections not identified. For example, rather than having three sections as identified in the examples herein, the bed may have additional, not herein identified sections, such as a thigh section, a leg section, etc. The follower member 41 connects the shield member 40 to the receiver 44 and allows the shield member 40 to translate relative to the receiver 44 in a designated orientation. The shield member 40 is sized to preclude access to the gap between the bed sections as a safety measure.

In a preferred embodiment, the shield member 40 is movably connected to the supplemental shield 46, as opposed to the receiver 44, to provide additional gap coverage. Correspondingly, in this embodiment the supplemental shield 46 is movably connected to the receiver 44. Further, in a most preferred embodiment, the shield member 40 is pivotally or rotatably connected to the supplemental shield 46, and the supplemental shield 46 is pivotally or rotatably, and also preferably translationally, connected to the receiver 44.

Figure 7:
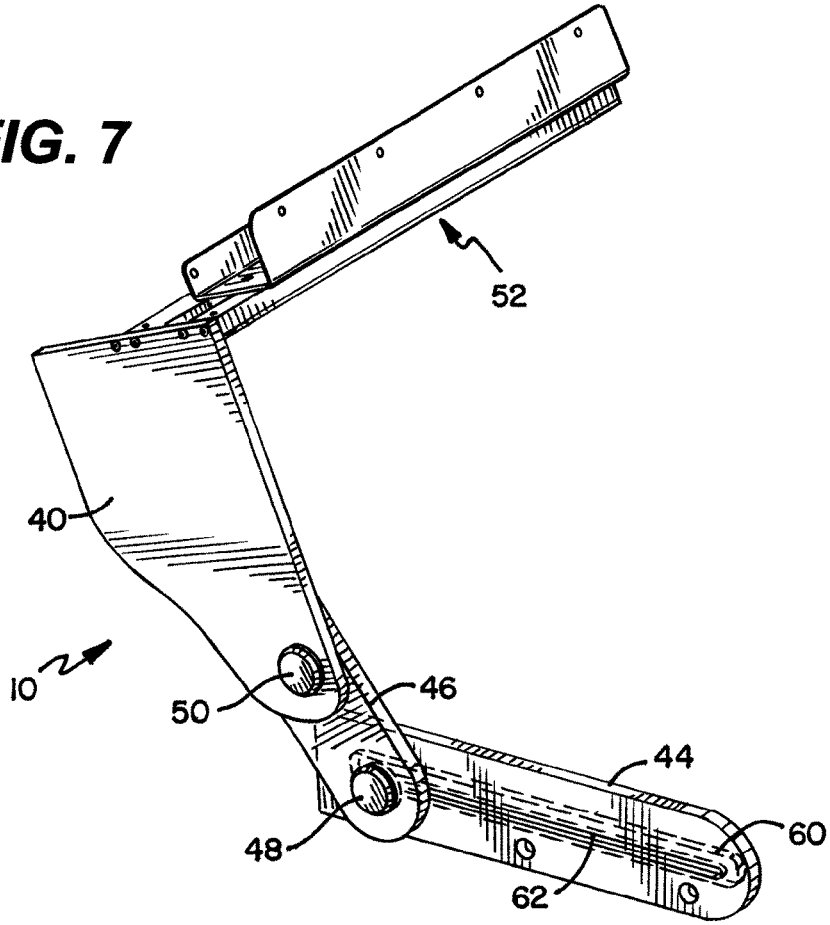
FIG. 7 is a perspective view of one embodiment of a gap shield assembly.
Figure 8:
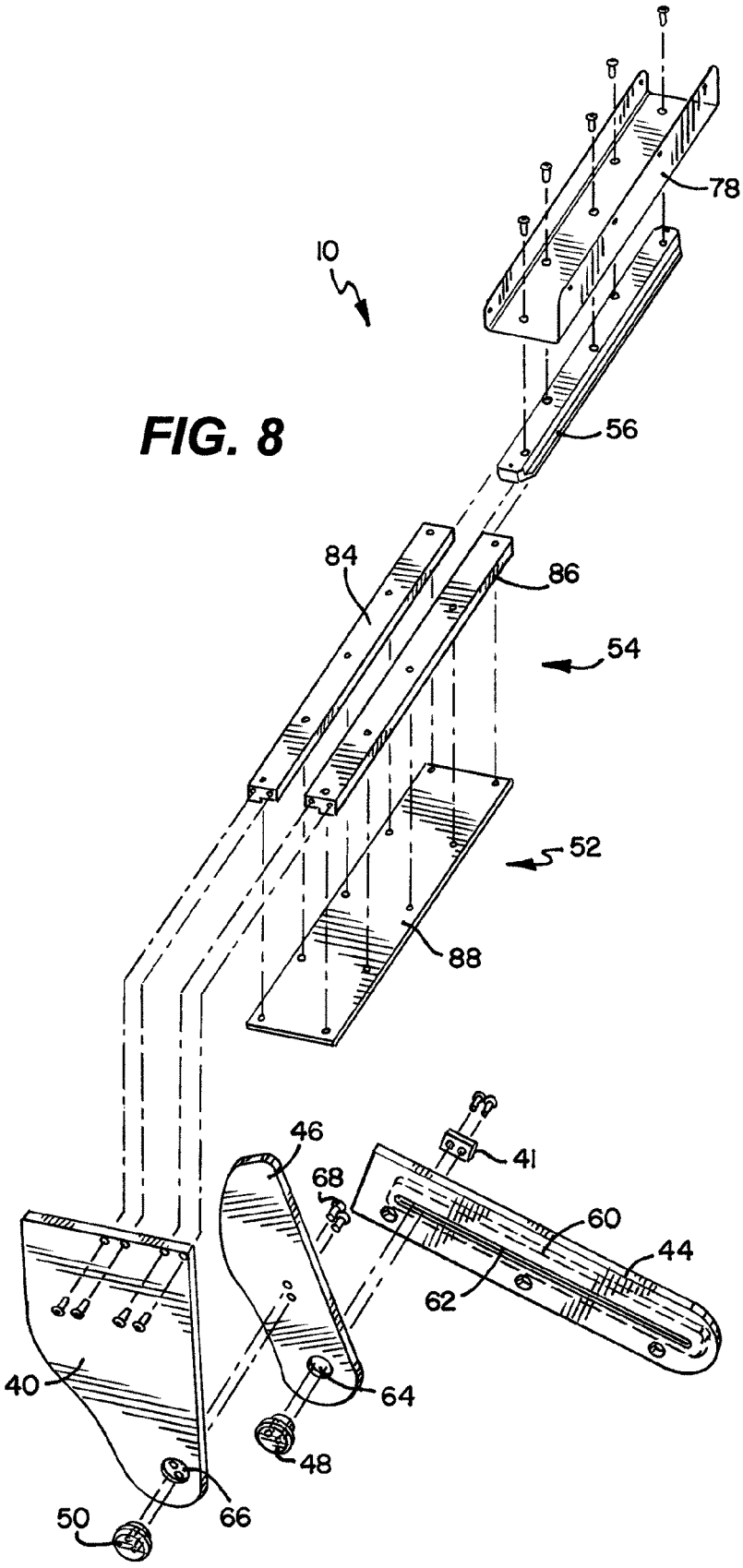
FIG. 8 is an exploded perspective view of the gap shield assembly of FIG. 7.

Referring to FIGS. 7 and 8, to connect the supplemental shield 46 to the receiver 44, the supplemental shield 46 is movably connected to the first coupler 48, and the first coupler 48 is fixedly connected to the follower member 41 in the receiver 44. Specifically, in one embodiment the receiver 44 has a longitudinal recess 60 and a through slot 62 extending into the recess 60. The follower member 41 is dimensioned to translate, preferably slidingly, back and forth in the longitudinal recess 60. Accordingly, since the first coupler 48 is fixedly connected to the follower member 41, as the follower member 41 translates axially or laterally within recess 60, the first coupler 48 and the supplemental shield 46 will correspondingly translate axially with respect to the receiver 44 as well.

The supplemental shield 46 preferably comprises a housing having an aperture 64 that movably receives the first coupler 48. As shown in FIGS. 7 and 8, the first coupler 48 has a cylindrical shaft component that mates with the aperture 64 in the supplemental shield 46 to allow the supplemental shield 46 to rotate about an axis of the shaft of the first coupler 48. Thus, since the supplemental shield 46 can rotate with respect to the first coupler 48, the supplemental shield 46 correspondingly can rotate with respect to the receiver 44.

As explained above, and shown in the Figures, in a preferred embodiment the shield member 40 preferably comprises a housing that is movably connected to the supplemental shield 46. Similar to the connection between the supplemental shield 46 and the receiver 44, the shield member 40 has an aperture 66 therein that movably receives the second coupler 50. As shown in FIG. 8, the second coupler 50 has a cylindrical shaft component that mates with the aperture 66 in the shield member 40 to allow the shield member 40 to rotate about an axis of the shaft of the second coupler 50. The second coupler 50 is also fixed via a connector 68 to the supplemental shield 46. In a preferred embodiment the second coupler 50 is bolted to the supplemental shield 46, just as the first coupler 48 is connected or bolted to the follower member 41.

Also as explained above, the shield member 40 is connected to one of the bed sections and the receiver 44 is connected to another of the bed sections, and in a preferred embodiment, such as shown in FIG. 1, the shield member 40 is connected to the head section 32 and the receiver 44 is connected to the seat section 34. Accordingly, in one embodiment where the shield member 40 is connected to the supplemental shield 46 near one end of the shield member 40, the shield member 40 is then connected to the head section 32 near another end of the shield member 40. In one embodiment the shield member 40 is fixed in a position relative to the bed section to which it is connected, i.e., the head section 32 in this embodiment. Alternately, the shield member 40 may be movably connected to the bed section, such as rotationally connected, similar to the rotational connection between the supplemental shield 46 and the receiver 44. Additionally, as explained herein, in one embodiment, shield member 40 may be able to translate inwardly and outwardly with respect to a centerline of the bed 12 to allow for an expandable width feature of the bed 12.

In another embodiment of the bed 12, shown in FIGS. 3-6, wherein the bed 12 has a variable width component, the bed 12 may have patient support extension assemblies, which may include mattress or deck extender assemblies, hereinafter referred to as mattress extender assemblies. Mattress extender assemblies may be provided at one or more sections of the bed 12. Additionally, mattress extender assemblies may be provided at each side of any section of the bed 12. In one embodiment, a first head mattress extender assembly 72 is provided at the first side 28 of the head section 32 of the bed 12, and a second head mattress extender assembly 72 is provided at the opposing second side 30 of the head section 32 of the bed 12. Similarly, in one embodiment, a first seat mattress extender assembly 74 is provided at the first side 28 of the seat section 34 of the bed 12, and a second seat mattress extender assembly 74 is provided at the opposing second side 30 of the seat section 34 of the bed 12. The head and seat first side mattress extender assemblies 72, 74 are utilized to increase the width of the bed 12 at the first side 28 of the bed 10, and the head and seat second side mattress extender assemblies 42, 44 are utilized to increase the width of the bed 12 at the second side 30 of the bed 12.

In a preferred embodiment, the head mattress extender assemblies 72 are movably connected to the head section 32 of the bed 12 and allowed to move relative thereto, and the seat mattress extender assemblies 74 are movably connected to the seat section 34 of the bed 12 and allowed to move relative thereto. In one embodiment, the mattress extender assemblies 72, 74 each have independent supplemental mattresses 76 associated therewith. Preferably, the first and second side head and seat mattress extender assemblies 72, 74 are each independently moveable from a first retracted position (see FIG. 1) to a second expanded position (see FIG. 6). In one embodiment the distance from the centerline of the bed 12 to an edge of the mattress 22 is identified as distance $W_1$, and the distance from the centerline of the bed 12 to an edge of the supplemental mattress 76 after the supplemental mattress 76 is in the expanded position is identified as distance $W_2$, and $W_2$ is greater than $W_1$. In a preferred embodiment, the width of the supplemental mattress 76 is approximately 5 inches, and thus the distance from $W_1$ to $W_2$ is approximately 5 inches. Thus, in a preferred embodiment the width of the supplemental mattress 76 is adapted to increase the width of the mattress 22 of the bed 12 approximately 5 inches per side, for a total mattress width increase of 10 inches. In a preferred embodiment, the supplemental mattresses 76 are movably connected to the mattress extender assemblies 72, 74 in both the retracted positions and the extended positions. It is further understood that in a preferred embodiment, the supplemental mattresses 76 are connected to the bed 12 in both the first position and the second position.

In a preferred embodiment, each of the mattress extender assemblies 72, 74 operate completely independently. Accordingly, any mattress extender assembly 72, 74 of the bed 12 may be in the retracted or non-deployed position, or the expanded or deployed position at any time, irrespective of any other mattress extender assembly 72, 74.

When mattress extender assemblies are utilized, the gap shield assembly 10 must allow for the different extender assemblies of adjacent bed sections to be in the retracted or expanded positions in use while still providing the gap shield features. To allow for such functionality, in one embodiment the gap shield assembly 10 also comprises an extender assembly 52, which in one embodiment incorporates a second follower member 54 and a second receiver 56. In one embodiment the extender assembly 52 of the gap shield assembly 10 allows the gap shield assembly 10 to move inwardly and outwardly (i.e., increased or decreased width) with one or more of the bed sections, while still allowing an adjacent bed section to move inwardly or outwardly without moving the gap shield assembly 10 inward or outward with respect to the centerline of the bed 12. Accordingly, in one embodiment the gap shield assembly 10 will cover the gap between the adjacent bed sections irrespective of the width location of the adjacent bed sections. Alternate preferred embodiments of the extender 52 are also provided in FIGS. 10-13. Additionally, in alternate embodiment of the extender assembly 52 when one section of the gap shield assembly 10 is moved inwardly or outwardly, the other sections of the gap shield assembly 10 are correspondingly moved inwardly or outwardly as well.

Figure 4:
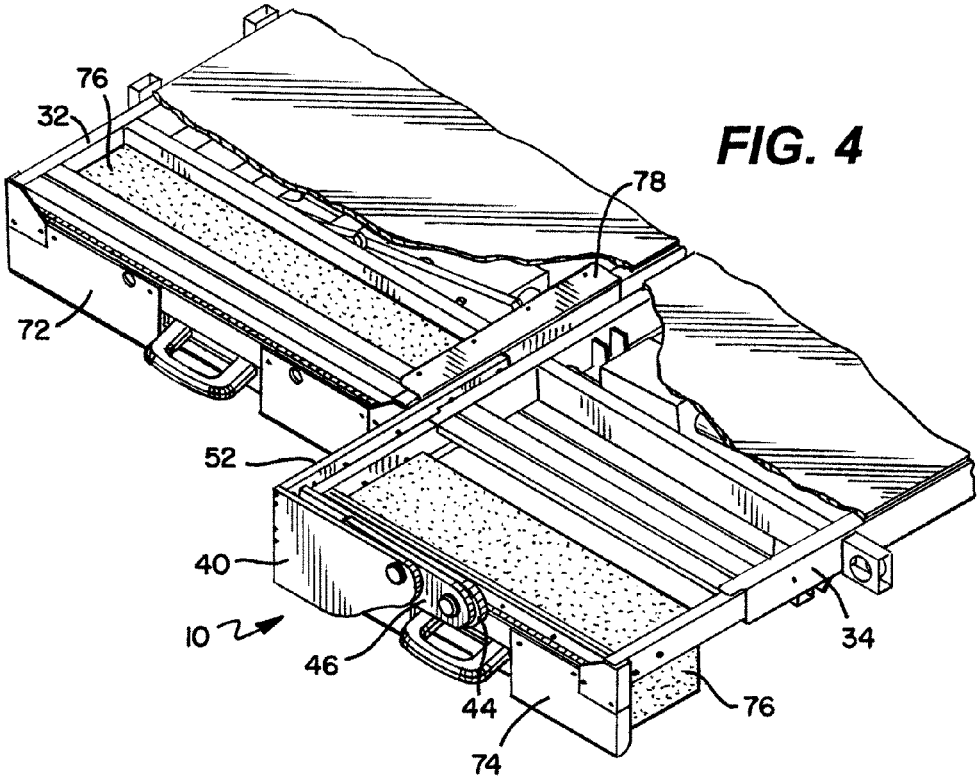
FIG. 4 is a partial cutaway perspective view of one embodiment of a hospital bed having mattress extenders, where the head mattress extender is in the closed position and the seat mattress extender is in the open position, and having a gap shield assembly between the head section and the seat section.

The extender 52 may be provided at either end component of the gap shield assembly 10 (i.e., either the shield member 40 or the receiver 44). In a preferred embodiment the extender 52 is connected to the gap shield assembly 10 adjacent one end of the shield member 40 as shown in FIG. 4. Additionally, a portion of the extender 52 is preferably connected to one of bed sections. Referring to FIG. 2, the extender 52 is connected to the head section 32 of the bed 12. Alternately, the extender 52 could be connected to any other section of the bed 12, such as the seat section 34.

Figure 9:
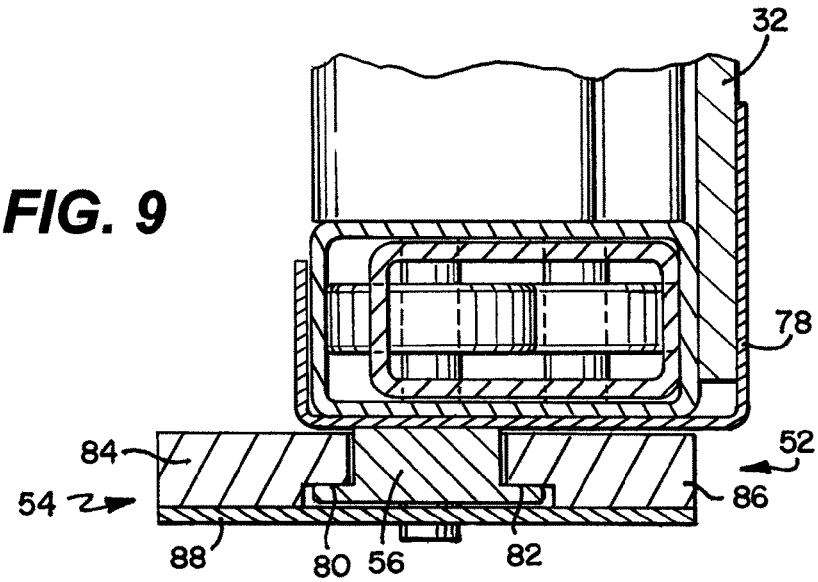
FIG. 9 is a cross-sectional view about line 9-9 of FIG. 2.

As explained above, in one embodiment the extender 52 comprises a second receiver 56 and a second follower member 54 that is movingly connected to the second receiver 56. As shown in FIGS. 7-9, in one embodiment, the second receiver 56 is fixedly connected to the head section 32 of the bed 12 with a bracket 78. Specifically, in one embodiment the second receiver 56 is connected to the bracket 78 with a plurality of screws, and then the bracket 78, with the second receiver 56 attached thereto, is connected to the head section 32. Accordingly, the second receiver 56 is fixed to the head section 32 and articulates with the head section 32 of the bed 12.

In a preferred embodiment the receiver 56 comprises a longitudinal member that provides a cam surface for the second follower member 54, and allows the second follower member 54 to translate inwardly and outwardly thereagainst. While the receiver 56 shown in the embodiments in the Figures is a single component, it may be provided in multiple sections or multiple components without departing from the spirit of the present invention. Additionally, as shown in FIG. 9, in one embodiment the receiver 56 has a first receiver surface 80 and a second receiver surface 82 to capture and translationally secure the second follower member 54.

In one embodiment, the second follower member 54 comprises two mating members or followers 84, 86, also referred to as first and second cam followers, that mate with the second receiver 56 and movingly engage the second receiver 56. However, the two followers 84, 86 could be made as one component. In the embodiment shown in FIG. 9, the first cam follower 84 engages the first receiver surface 80 and the second cam follower 86 engages the second receiver surface 82. The first and second cam followers 84, 86 are connected to a backing plate 88 to maintain the cam followers 84, 86 in alignment with the second receiver 56. Additionally, as shown in FIGS. 7 and 8, the second follower member 54 is connected, at each of the cam followers 84, 86 in one embodiment, to the shield member 40.

Figure 10:
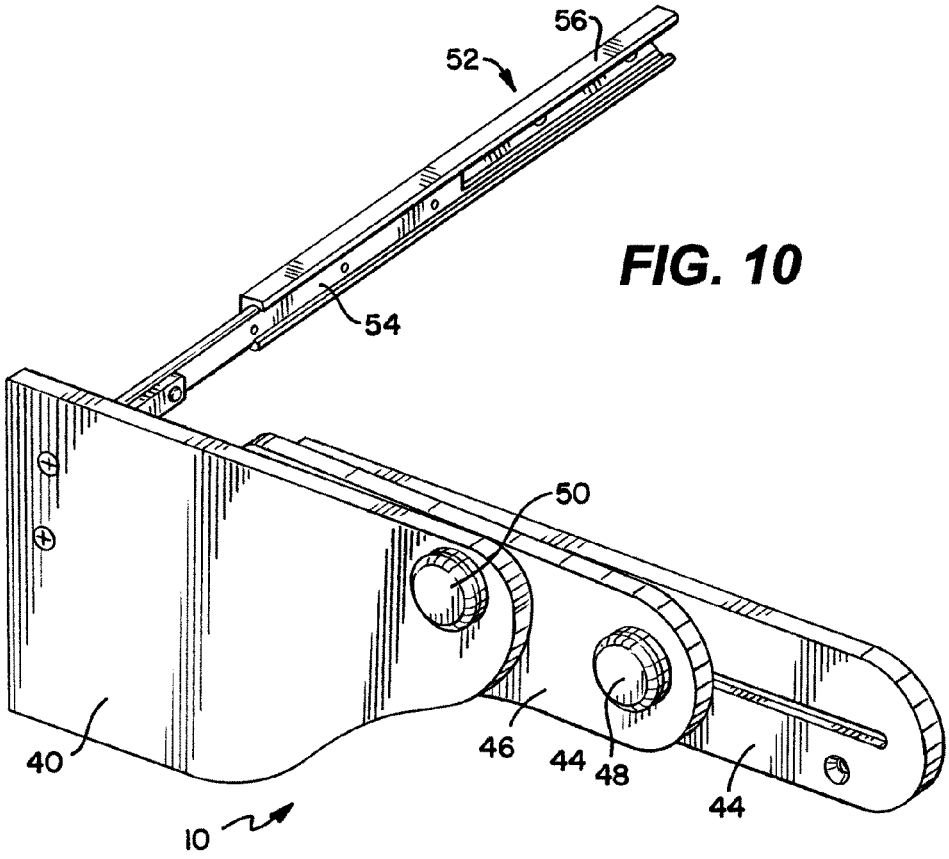
FIG. 10 is a perspective view of another embodiment of an extender for the gap shield assembly.

In an alternate embodiment, the extender 52 of the gap shield assembly 10 may comprise the structure shown in FIG. 10. Therein, the extender 52 generally comprises a second receiver 56 and a second follower member 54 in the form of a track assembly 52. The second receiver 56 of the extender 52 is preferably connected to the head section 32, the second follower member 54 rides in the track of the second receiver 56. In one embodiment, the second receiver 56 may take the shape of a U-shaped track receiver.

Referring to the Figures, the gap shield assembly 10 is preferably connected to the bed 12 in all orientations of the bed 12, including when the different bed sections articulate, and when the different mattress widening sections are extended and retracted. Additionally, a first gap shield assembly is preferably provided at a first side of the bed and a second gap shield assembly is preferably provided at the second side of the bed.

FIG. 1 is a perspective view of one embodiment of a hospital bed 12 with the head section 32 in an upward position. The gap shield provides a shield to prevent access to the gap between the head section 32 and the seat section 34. As shown in the embodiment of FIG. 1, the receiver 44 is connected to the seat section 34 and the shield member 40 is connected to the head section 32. Specifically, in this embodiment the shield member 40 is connected to the head section 32 through the extender 52. The supplemental shield 46 is rotatedly connected to both the shield member 40 and the receiver 44, and therefore rotatedly connects the shield member 40 to the receiver 44 with the use of first and second couplers 48, 50. In the orientation of FIGS. 1 and 2, the deck or mattress extenders 72, 74 are in the closed position and the gap shield 10 is between the head section 32 and the seat section 34 to prevent side access to the gap between the head and seat sections 32, 34 of the bed 12. Because the head section 32 is partially in the up position, the shield member 40 and supplemental shield 46 are rotated and translated with respect to the receiver 44 to cover the gap between the head and seat sections 32, 34.

Referring to FIG. 3, the head section 32 and seat section 34 are both in their lowered positions, and the mattress extenders 72, 74 are in the in or narrow position (also referred to as the closed position). The gap shield assembly 10 is provided between the head section 32 and the seat section 34.

As shown in FIG. 4, the seat mattress extender 74 has been opened to the wide position, such that the mattress in the seat section 34 can be made wider, but the head section mattress extender 72 is maintained in the narrow position. The receiver 46 is still connected to the seat section 34, and as shown in FIG. 4, it is preferably connected to the seat mattress extender 74 of the seat section 34. The extender 52, and specifically the second receiver 56 of the extender 52, is connected to the head section 32, and the second follower member 54 has translated with respect to the second receiver 56 to allow the second follower member 54 to translate outwardly with respect to the mid-line of the bed 12. Accordingly, even when one mattress extender is in the out position and another mattress extender in an adjoining section of the bed is in the in position the gap between the two adjoining bed sections is covered.

Figure 5:
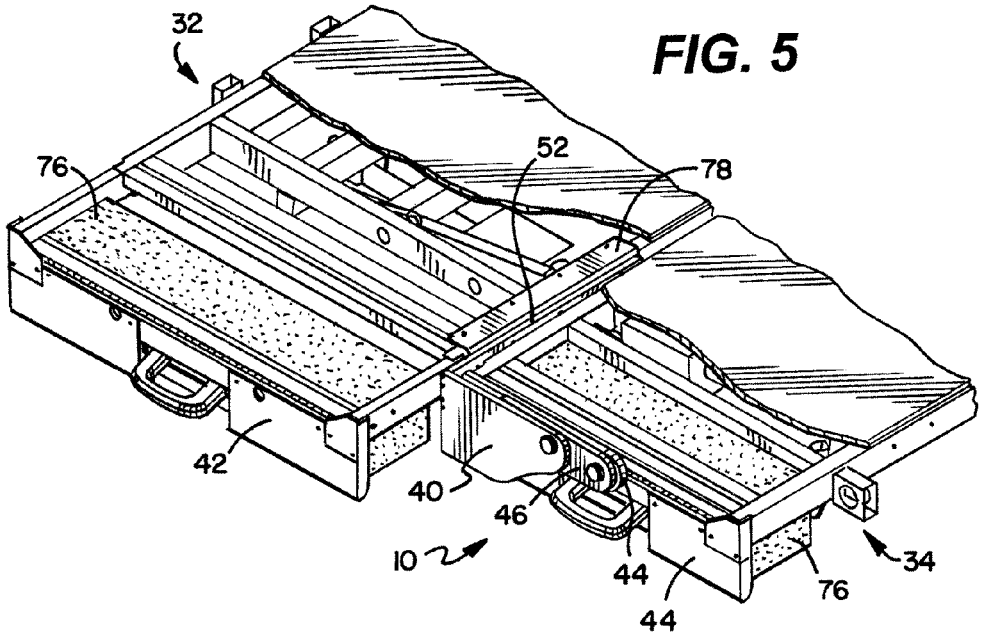
FIG. 5 is a partial cutaway perspective view of one embodiment of a hospital bed having mattress extenders, where the head mattress extender is in the open position and the seat mattress extender is in the closed position, and having a gap shield assembly between the head section and the seat section.

The embodiment of FIG. 5 illustrates a configuration where the head mattress extender 72 is in the open or extended position and the seat mattress extender 74 is in the closed position. In this embodiment the receiver 46 is still connected to the seat section 34 and the shield member 40, through the extender 52, is connected to the head section 32. Interestingly, in this embodiment, as the head mattress extender 72 is extended, the gap shield assembly 10 remains in the same position covering the gap between the head section 32 and the seat section 34 as it did when the head mattress extender 72 was in the retracted position.

Figure 6:
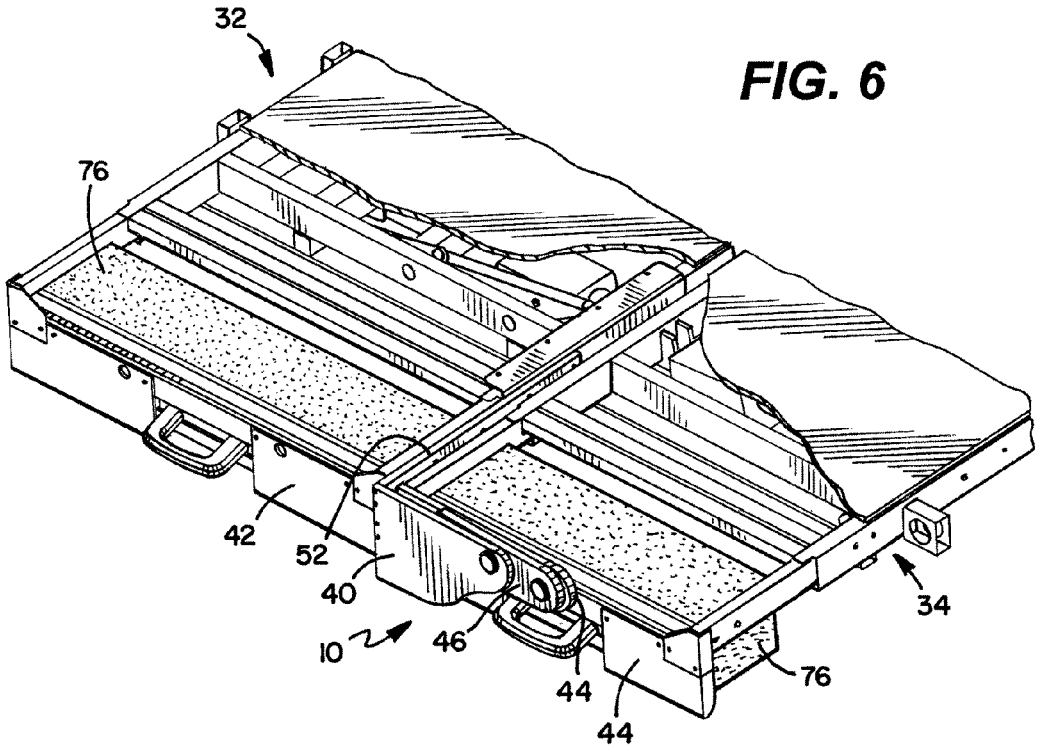
FIG. 6 is a partial cutaway perspective view of one embodiment of a hospital bed having mattress extenders, where the head mattress extender is in the open position and the seat mattress extender is in the open position, and having a gap shield assembly between the head section and the seat section.

Whereas in FIG. 5 the head mattress extender 72 is in the open or extended position and the seat mattress extender 74 is in the closed position, in FIG. 6 the seat mattress extender 74 is also opened to the wide position, similar to the head mattress extender 72. Similar to the embodiment of FIG. 4, in the embodiment of FIG. 6, the second follower member 54 has translated with respect to the second receiver 56 to allow the second follower member 54 to translate outwardly with respect to the mid-line of the bed 12 with the seat mattress extender 74. In this configuration the different sections of the bed 12 may also articulate up and down, and the gap shield 10 will translate therewith, as shown in examples of FIGS. 1, 2 and 3 (also see FIG. 7).

Figure 11:
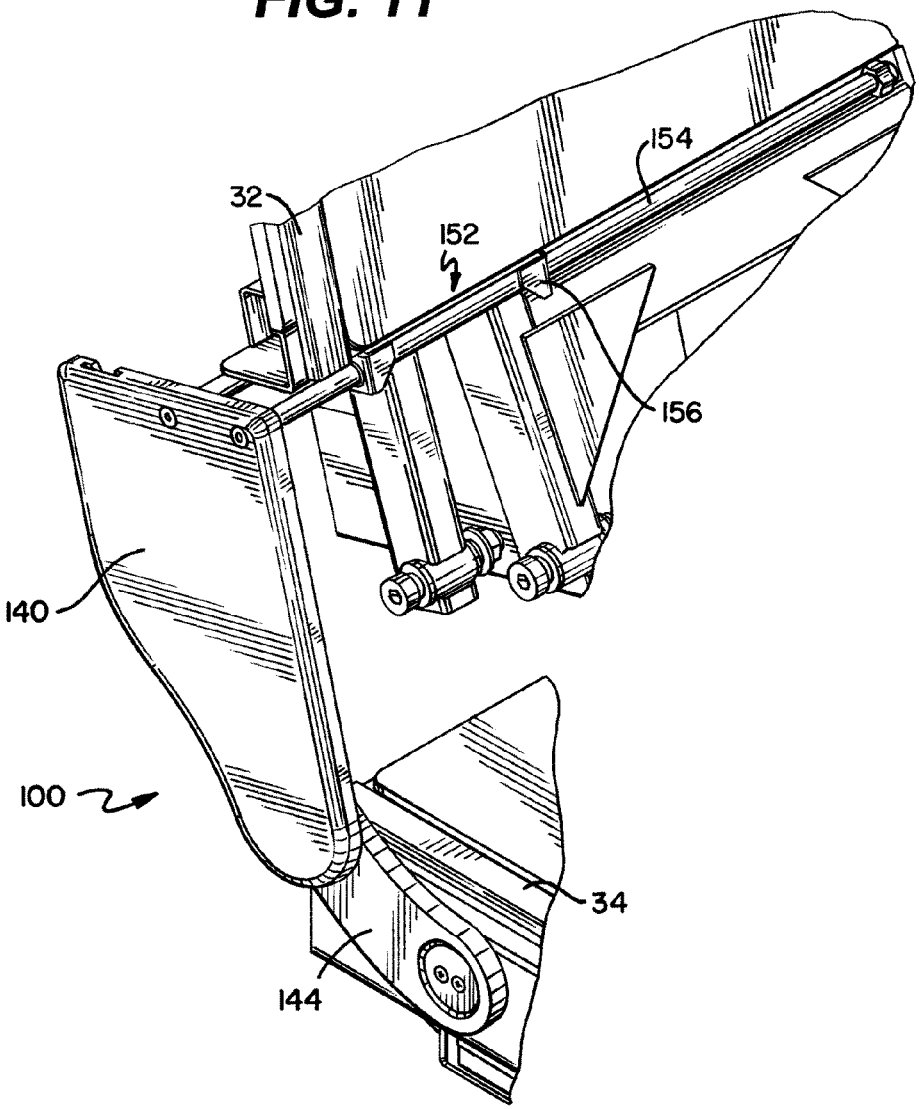
FIG. 11 is a perspective view of another embodiment of a gap shield assembly with the head section of the bed raised, such as in the chair configuration.
Figure 12:
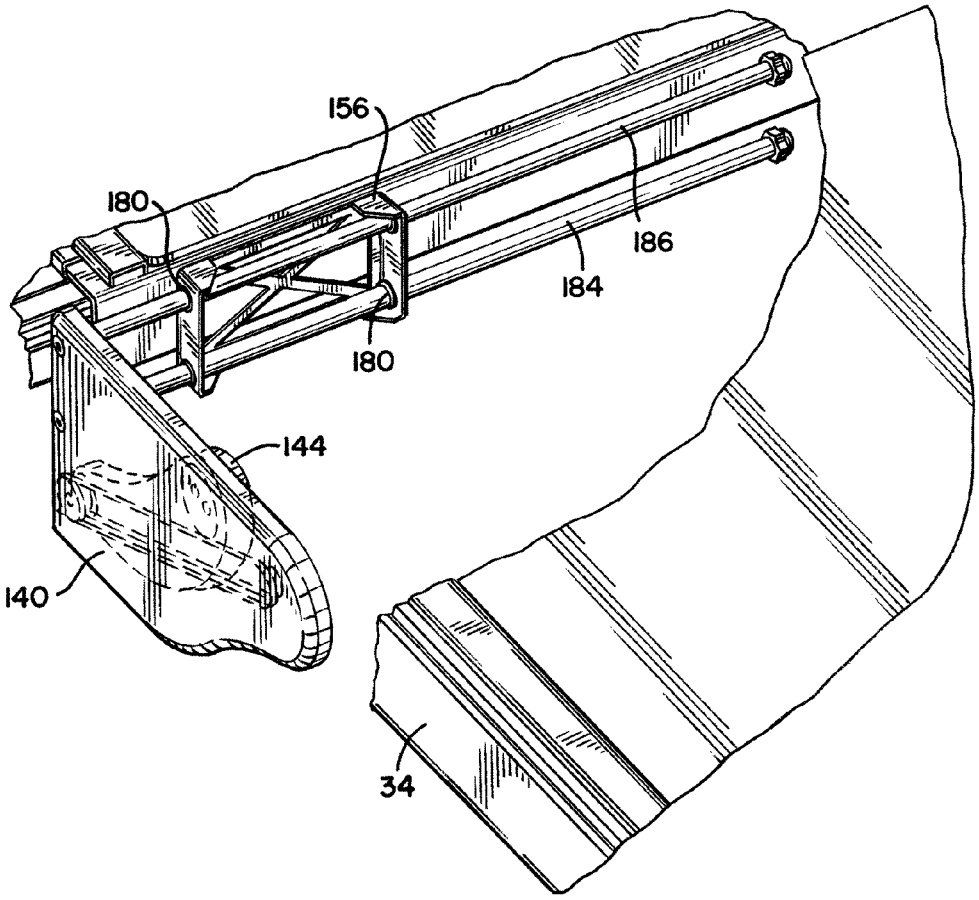
FIG. 12 is a perspective view of the gap shield assembly of FIG. 11, with the bed in a standard horizontal configuration; and, FIG. 13 is an exploded perspective view of the gap shield assembly of FIG. 11.
Figure 13:
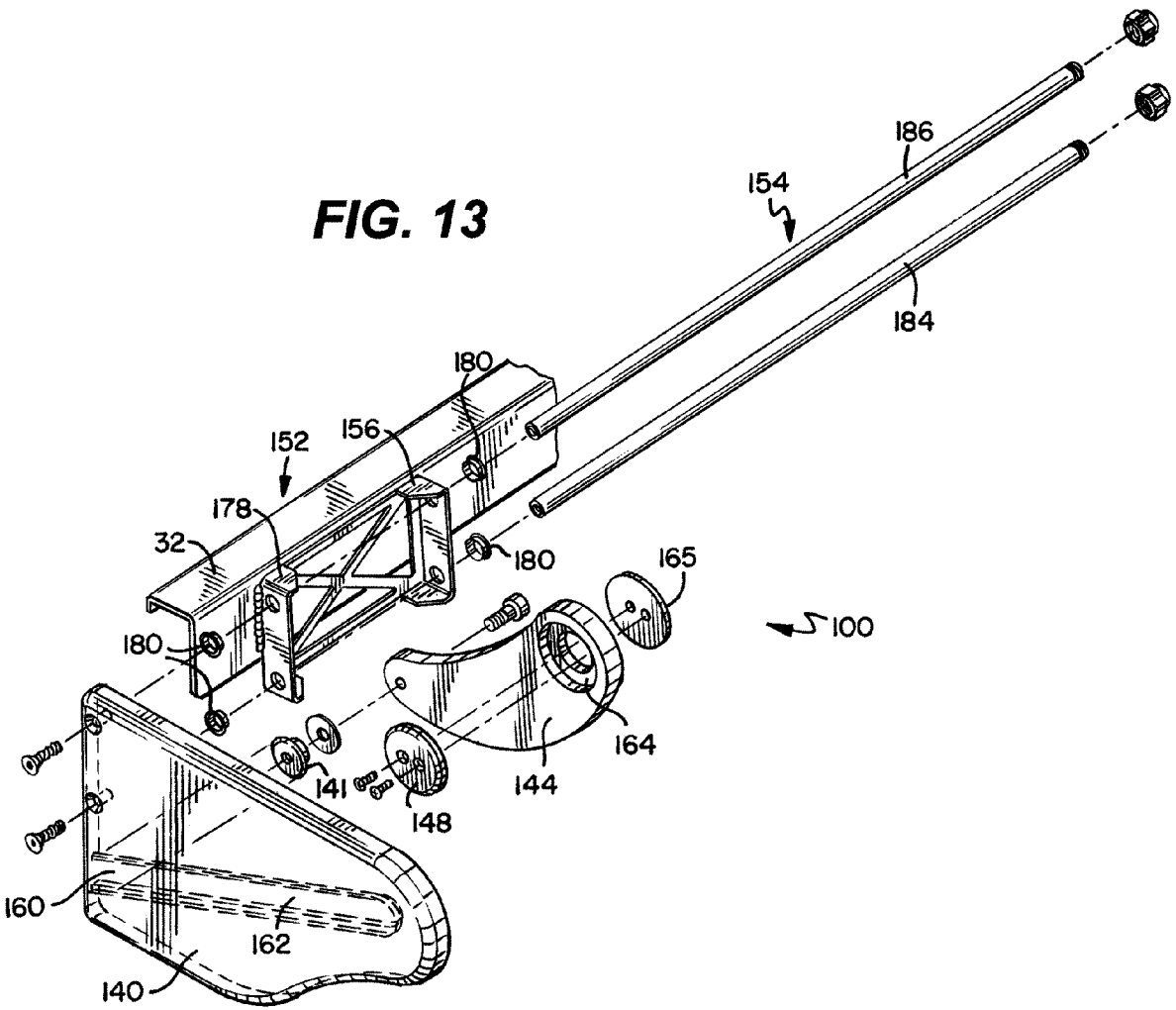

Referring now to FIGS. 11-13, there is shown another embodiment of the gap shield assembly described above. The gap shield assembly 100 has a shield member 140, a follower member 141 and a receiver 144. The receiver 144 is also referred to as the second shield member 144. Generally, however, this embodiment of the gap shield assembly does not require a supplemental shield. Rather, in this embodiment the receiver 144 is rotatably connected to one of the bed sections with a coupler 148, and the shield member 140 is rotationally and translationally connected to the receiver 144. Additionally, the gap shield assembly 100 also comprises an extender assembly 152 to allow the gap shield assembly 100 to move in an out. The extender 152 comprises a second follower member 154 and a second receiver 156. As explained above, the extender 152 is generally not needed unless the bed has expandable width aspects thereto.

As explained above, the shield member 140 (also referred to herein as the first shield member 140) is generally connected to one of the bed sections and the receiver 144 (also referred to herein as the second shield member 144) is connected to another of the bed sections. For example, as shown in FIGS. 11-13, the first shield member 140 is connected to the head section 32 and the receiver 144 or second shield member 144 is connected to the seat section 34, however, it is understood that the connections may be reversed or that they may be connected to different sections of the bed, including sections not identified. The follower member 141 connects the shield member 140 to the receiver 144 and allows the shield member 140 to translate relative to the receiver 144 in a designated orientation. The shield member 140 is sized to preclude access to the gap between the bed sections as a safety measure. Moreover, in a preferred embodiment, the shield member 140 is movably connected to the receiver 144, and the receiver 144 is movably connected to the bed section. Further, in a most preferred embodiment, the shield member 140 is pivotally or rotatably connected to the receiver 144, and the shield member 140 is also translationally connected to the receiver 144 via the follower 141. Similarly, the receiver 144 is pivotally or rotatably connected to the bed section 34. Generally, the first shield member 140 and second shield member 144 are not separable during articulation of the bed. In one embodiment, the receiver 144 or second shield member 144 is laterally fixed by the coupler because it cannot translate about the longitudinal axis of the bed and can only rotate.

As shown in FIG. 13, the receiver 144 has a counterbore 164 therein, at one end thereof, that movably receives the coupler 148 to assist in accomplishing rotation/pivoting of the receiver 144. In one embodiment, the coupler 148 has a cylindrical component that mates with the counterbore 164 in the receiver 144 to allow the receiver 144 to rotate about an axis of the coupler 148. The coupler 148, however, is fixed to the seat section 34 of the bed, such as with two bolts. Additionally, a bushing 165 or washer 165 may be placed between the seat section 34 of the bed and the receiver 144.

Next, to connect the shield member 140 to the receiver 144, the shield member 140 is movably connected to the follower 141, and the follower 141 is fixedly connected to the receiver 144. Specifically, in one embodiment the shield member 140 has an internal longitudinal recess 160 and a through slot 162 extending into the recess 160, thereby forming an internal T-shaped slot or cam track as shown in FIG. 13. The follower member 141 operates as a cam and is dimensioned to translate, preferably slidingly, back and forth in the longitudinal recess 160. Additionally, in a preferred embodiment the follower member 141 has a cylindrically-shaped flange component that engages the recess 160 and which secures the follower member 141 within the recess 160, but which also allows the follower member 141 to rotate about the axis of the cylindrical component within the longitudinal recess 160. Accordingly, since the follower member 141 is fixedly connected to the receiver 144, as the follower member 141 translates axially or laterally and rotates within recess 160, the shield 140 will correspondingly translate axially with respect to the longitudinal axis of the bed and rotationally with respect to the receiver 144. Thus, in one position whereby the bed is in the substantially horizontal position, the receiver 144 will be generally behind and blocked by the shield 140 (see FIG. 12). When the head section 32 of the bed is raised, however, the shield 140, which is connected to the head section 32, moves with the head section 32 and translates and rotates with respect to the receiver 144, thereby exposing the receiver 144 as shown in FIG. 11. Accordingly, the first shield member is movably connected to the second shield member during articulation of the bed.

As explained above, in another embodiment of the bed 12, the bed 12 has a variable width component, which may include mattress or deck extender assemblies. When mattress extender assemblies are utilized, the gap shield assembly preferably must allow for the different extender assemblies of adjacent bed sections to be in the retracted or expanded positions in use while still providing the gap shield features. To allow for such functionality, in one embodiment the gap shield assembly 100 also comprises an extender 152, which in one embodiment incorporates a second follower member 154 and a second receiver 156. The extender 152 of the gap shield assembly 100 allows the gap shield assembly 100 to move inwardly and outwardly with one or more of the bed sections, but to allow an adjacent bed section to move inwardly or outwardly without moving the gap shield assembly 100 inward or outward with respect to the centerline of the bed 12. Accordingly, the gap shield assembly 100 will cover the gap between the adjacent bed sections irrespective of the width location of the adjacent bed sections.

The extender 152 may be provided at either end component of the gap shield assembly 100 (i.e., either the shield member 140 or the receiver 144). In a preferred embodiment the extender 152 is connected to the gap shield assembly 100 adjacent one end of the shield member 140 as shown in FIGS. 11-13. Additionally, a portion of the extender 152 is preferably connected to one of bed sections. Referring to FIGS. 11-13, in this embodiment the extender 152 is connected to the head section 32 of the bed 12. Alternately, the extender 152 could be connected to any other section of the bed 12, such as the seat section 34.

As explained above, in one embodiment the extender 152 comprises a second receiver 156 and a second follower member 154 that is movingly connected to the second receiver 156. In one embodiment, the second receiver 156 comprises a bracket 178 having a plurality of bearings 180 or bushings 180. The bracket 178 is fixedly connected to the head section 32. Accordingly, the second receiver 156 is fixed to the head section 32 and articulates with the head section 32 of the bed 12. In a preferred embodiment, the receiver 156 provides a cam surface for the second follower member to translate inwardly and outwardly thereagainst.

In one embodiment, the second follower member 154 comprises two rods 184, 186 that extend through the bearings 180 to allow the rods 184, 186 to translationally engage the second receivers 156. The rods 184, 186 are fixedly connected to the gap shield 140 at one end thereof, and have a stopper member at the other end thereof to prevent the rods 184, 186 from disengaging from the second receiver 156. Accordingly, the gap shield assembly 100 is able to translate inwardly and outwardly as desired. In this configuration, the first shield member 140 cannot rotate with respect to the second of the bed to which it is connected (i.e., the head or first deck section).

Referring to the Figures, the gap shield assembly 100 is preferably connected to the bed 12 in all orientations of the bed 12, including when the different bed sections articulate, and when the different mattress widening sections are extended and retracted. Additionally, a first gap shield assembly is preferably provided at a first side of the bed and a second gap shield assembly is preferably provided at the second side of the bed.

While different beds are referenced herein, such as a standard bed, a chair bed, an expanding width bed, etc., it is understood that any feature of the gap shield disclosed herein may be utilized with any type of patient support mechanism, and reference to one type of bed respecting a particular feature does not preclude incorporation of that feature into any other type of bed.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A gap shield assembly for shielding side access to an open area between a first section of a bed and an adjacent second section of the bed, the first and second sections of the bed having a support deck to support a mattress, comprising:

a first shield member positioned adjacent a first side of the bed and exterior of the support deck of the bed, the first shield member orientated transverse to the support deck;

a second shield member positioned adjacent the first side of the bed and exterior of the support deck of the bed, the second shield member orientated transverse to the support deck, the first shield member mechanically connected to the second shield member when the bed is in the horizontal position and when the first section of the bed is raised; and, a width extender assembly connecting one of the first shield member to the first section of the bed and the second shield member to the adjacent second section of the bed to allow the shield member connected to the width extender assembly to move inwardly and outwardly with respect to a centerline of the bed while still shielding side access to the open area between the first and second sections of the bed.

2. The gap shield assembly of claim 1, wherein the first shield member and the second shield member are not separable during articulation of the bed.

3. The gap shield assembly of claim 1, wherein one of the first shield member and the second shield member is rotationally connected to the section of the bed to which it is connected, and where the other of the first shield member and the second shield member cannot rotate with respect to the section of the bed to which it is connected.

4. The gap shield assembly of claim 1, further comprising a supplemental shield between the first shield member and the second shield member, the supplemental shield rotationally connected to the first shield member and the supplemental shield rotationally connected to the second shield member.

5. The gap shield assembly of claim 1, further comprising a coupler rotationally connecting the second shield member to the seat section, and a follower rotationally connecting the first shield member to the second shield member.

6. The gap shield assembly of claim 1, wherein one of the first shield member and the second shield member has a cam track for retaining a cam connected to the other of the first shield member and second shield member for rotationally and translationally securing the first shield member to the second shield member.

7. The gap shield assembly of claim 1, wherein the width extender assembly is connected to the first shield member and the first section of the bed, and wherein the width extender assembly further comprises an extender receiver connected to the first section of the bed and an extender follower member that is connected to the first shield member, and wherein the extender follower member is movably connected to the extender receiver.

8. A gap shield assembly for shielding side access to an open area between adjacent support deck sections of a bed, comprising:

a first shield member connected to a first section of the bed and positioned adjacent a first side of the bed and exterior of the support deck of the bed, the first shield member orientated transverse to the support deck;

a second shield member connected to a second section of the bed and positioned adjacent the first side of the bed and exterior of the support deck of the bed, the second shield member orientated transverse to the support deck, the first shield member being movably connected to the second shield member during articulation of the bed, wherein one of the first shield member and the second shield member translates about a longitudinal axis of the bed and rotates with respect to the other of the first shield member and the second shield member during articulation of the bed, and wherein the other of the first shield member and the second shield member remains laterally fixed about a longitudinal axis of the bed during articulation of the bed.

9. The gap shield assembly of claim 8, wherein the first and second shield members are provided below a deck surface of the bed.

10. The gap shield assembly of claim 8, wherein the shield member that remains laterally fixed about a longitudinal axis of the bed during articulation of the bed also rotates with respect to the bed during articulation of the bed.

11. The gap shield assembly of claim 10, further comprising a coupler rotationally connecting the second shield member to the second section of the bed, the coupler laterally fixing the position of the second shield member respecting the bed.

12. The gap shield assembly of claim 11, wherein the first shield member has a cam track for retaining a cam connected to the second shield member for rotationally and translationally securing the second shield member to the first shield member.

13. The gap shield assembly of claim 8, further comprising a width extender assembly connecting the first shield member to the first section of the bed, the width extender assembly provides for the first shield member to move inwardly and outwardly with respect to a centerline of the bed while still shielding the open area between the first and second sections of the bed.

14. The gap shield assembly of claim 13, wherein the width extender assembly comprises an extender receiver connected to the first section of the bed and an extender follower member connected to the first shield member, the extender follower member being movably connected to the extender receiver.

15. A gap shield assembly for shielding side access to an open area between a head section of a bed and an adjacent seat section of a bed, the head and seat sections of the bed having a support deck to support a mattress, comprising:

a first shield member connected to the head section of the bed and positioned adjacent a side of the bed and exterior of the support deck of the bed, the first shield member orientated transverse to the support deck;

a second shield member connected to the seat section of the bed and positioned adjacent a side of the bed and exterior of the support deck of the bed, the second shield member orientated transverse to the support deck; and, wherein one of the first shield member and the second shield member is rotationally connected to the section of the bed to which it is connected to rotate with respect to the bed section to which it is connected, wherein the other of the first shield member and the second shield member is rotationally fixed to the section of the bed to which it is connected, and wherein one of the first shield member and the second shield member has a cam track for retaining a cam connected to the other of the first shield member and second shield member for rotationally and translationally securing the first shield member to the second shield member.

16. The gap shield assembly of claim 15, further comprising a coupler rotationally connecting the second shield member to the second section of the bed, the coupler laterally fixing the position of the second shield member with respect to the bed.

17. The gap shield assembly of claim 16, wherein the first shield member has a cam track for retaining a cam connected to the second shield member for rotationally and translationally securing the second shield member to the first shield member.

18. The gap shield assembly of claim 15, further comprising a supplemental shield between the first gap shield and the second gap shield, the supplemental shield rotatably connected to the first gap shield.

19. The gap shield assembly of claim 15, further comprising a width extender assembly connecting the first shield member to the first section of the bed, the width extender assembly provides for the first shield member to move inwardly and outwardly with respect to a centerline of the bed while still shielding the open area between the first and second sections of the bed.

20. The gap shield assembly of claim 19, wherein the width extender assembly comprises an extender receiver connected to the first section of the bed and an extender follower member connected to the first shield member, the extender follower member being movably connected to the extender receiver.

* * * * *